US005527109A

United States Patent [19]

Meyer

[11] Patent Number: 5,527,109

[45] **Date of Patent: * Jun. 18, 1996**

[54] DEVICE FOR THE PROPULSION OF AN OLOID SHAPED TUMBLER BODY

[75] Inventor: Pio Meyer, Wald, Switzerland

[73] Assignee: Bioengineering AG, Wald, Switzerland

[ * ] Notice: The term of this patent shall not extend beyond the expiration date of Pat. No. 5,492,405.

[21] Appl. No.: 211,199

[22] PCT Filed: May 26, 1993

[86] PCT No.: PCT/CH93/00134

§ 371 Date: Jun. 17, 1994

§ 102(e) Date: Jun. 17, 1994

[87] PCT Pub. No.: WO94/02235

PCT Pub. Date: Feb. 3, 1994

[30] Foreign Application Priority Data

Jul. 20, 1992 [CH] Switzerland ..... 02 260/92

[51] Int. Cl.[6] ..... B01F 13/00

[52] U.S. Cl. ..... 366/208; 366/219

[58] Field of Search ..... 366/53, 55, 208, 366/211, 219, 62, 63, 233; 74/60, 61, 86; 451/326–330

[56] References Cited

U.S. PATENT DOCUMENTS

| | | | |
|---|---|---|---|
| 2,302,804 | 11/1942 | Schatz | 366/209 |
| 2,991,657 | 7/1961 | Schatz | 74/86 X |
| 3,186,243 | 6/1965 | Urban | 74/86 |
| 3,824,866 | 7/1974 | Schatz | 74/61 |
| 4,341,475 | 7/1982 | Saladin | 366/211 |
| 4,669,225 | 6/1987 | Kuster | 366/219 X |
| 5,360,265 | 11/1994 | Cruse | 366/219 X |

FOREIGN PATENT DOCUMENTS

| | | | |
|---|---|---|---|
| 3542285 | 8/1986 | Germany . | |
| 242218 | 9/1946 | Switzerland | 74/86 |
| 500000 | 12/1970 | Switzerland . | |
| 1197713 | 12/1985 | U.S.S.R. | 366/219 |
| 1607922 | 11/1990 | U.S.S.R. | 366/219 |

*Primary Examiner*—Charles E. Cooley

[57] ABSTRACT

An oloid-shaped body is placed on, and driven by, a conveyor belt. Two embodiments of the oloid shaped body are a hollow body with a closable opening, and a skeleton body for attachment of vessels. A shaft is attached to the oloid-shaped body and has the position and direction of the longitudinal axis of the oloid-shaped body. A hollow shaft allows access to the oloid-shaped body during movement. A frame is positioned on either side of the conveyor belt, with a plurality of spring attachments connecting an oval guiding rail to each of the frames. A carriage runs around each of the guiding rails and guides an end of the shaft in an oval path. In this manner the oloid-shaped body tumbles in a stationary location on the conveyor belt. An alternative to using the combination of frames, guiding rails, and carriages, is the use of a mechanism which causes the two ends of the shaft to rotate in the same rotational path but in opposite directions.

31 Claims, 7 Drawing Sheets

DEVICE FOR THE PROPULSION OF AN OLOID SHAPED TUMBLER BODY

BACKGROUND OF THE INVENTION

1. Field of the Invention

The present invention relates to a device for the propulsion of a tumbler body and, more particularly, to a device for the propulsion of a tumbler body in the shape of an oloid.

2. History of the Related Art

CH-patent 500 000 describes a device for the generation of a tumbling motion. This device consists of a body that Paul Schatz, in his book "Rhythmusforschung und Technik" (Stuttgart 1975), refers to as an "oloid." This oloid, according to CH-A1 500 000, is driven by a conveyor belt which carries the oloid. This drive was not very popular in practical applications, because it requires a perfectly shaped oloid and no slip during the rolling of the oloid. Guide rollers, which are commonly used on drum-shaped rolling elements, cannot be used with the shape of the oloid. Even though it has, much like a cylinder, a straight contact line on one plane, the angle of this contact line changes in an oscillatory manner with respect to the direction of travel. Therefore, the invention never became successful. This is not the case with the solution presented in CH-patent 216 760 in which a hollow body, executing a tumbling motion, is part of a half Bricard link chain. This solution has been successful in the market employing various designs and different means of propulsion. But it has the tremendous disadvantage that prevents the construction of a mixer based on the oloid or inversion principle with a capacity of one or more cubic meters. This disadvantage is caused by the high mass forces occurring during operation that constantly change in size and direction. These mass forces require extremely large components and, thus, represent extreme challenges to the base of such a machine.

The purpose of this invention is the creation of a drive for an oloid body that overcomes these disadvantages and is also suited for oloids with large dimensions.

SUMMARY OF THE INVENTION

The present invention relates to a device for the propulsion of a tumbler body. More particularly, one aspect of the invention includes a device for the propulsion of a tumbler body in the shape of an oloid positioned on and driven by a conveyor belt characterized by a shaft attached to this tumbler body exhibiting the direction and position of its longitudinal axis. Means are provided to guide this shaft in two upright parallel planes and exhibiting the direction of the conveyor belt movement, located on each side of the conveyor belt in an oval path, with the movement of the trace points of the axis of the shaft through both planes in the same rotary direction, but basically in opposite directions.

In another aspect, the invention relates to the device described above wherein the means necessary to guide the trace points of the axis of the shaft with the two parallel planes on oval paths includes an oval guiding rail present in both planes, which rail is connected to a frame by at least four spring attachments which allow for a vertical movement. A carriage is attached to each guiding rail that can travel along these guiding rails and each carriage consists of a frame carrying at least two guiding wheels responsible for the friction-type and positive connection with the guiding rail, and a rotary joint on the frame, whose rotary axis is perpendicular to the tangent at the guiding rail and lies in its plane with its rotary part being a plate rotating by means of a rotary joint carrying a crossbeam parallel to the direction of the tangent at the guiding rail. A guiding element is present in which the shaft can execute longitudinal and rotary motions and that can be swivelled around the mentioned crossbeam at the plate. The dimensions of the guiding rail, carriage with rotary joint, plate, and guiding element are designed so that the trace points of the axis of the shaft describe the intended oval curve in the planes when the tumbler body is moved by the conveyor belt.

BRIEF DESCRIPTION OF THE DRAWINGS

For a more complete understanding of the present invention and for further objects and advantages thereof, reference may now be had to the following description taken in conjunction with the accompanying drawings in which.

DETAILED DESCRIPTION

Figure 1A:
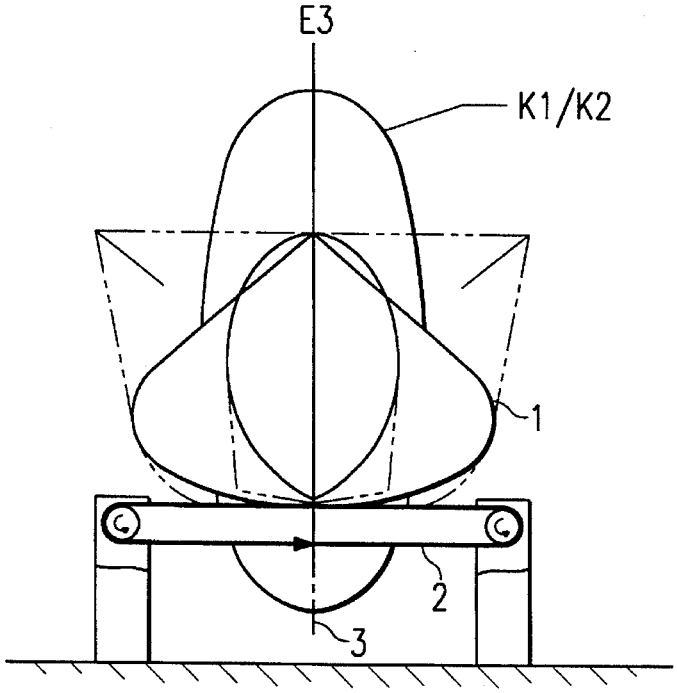
FIG. 1*a* and FIG. 1*b* are diagrams of the geometric relationship of an oloid during movement.
Figure 1B:
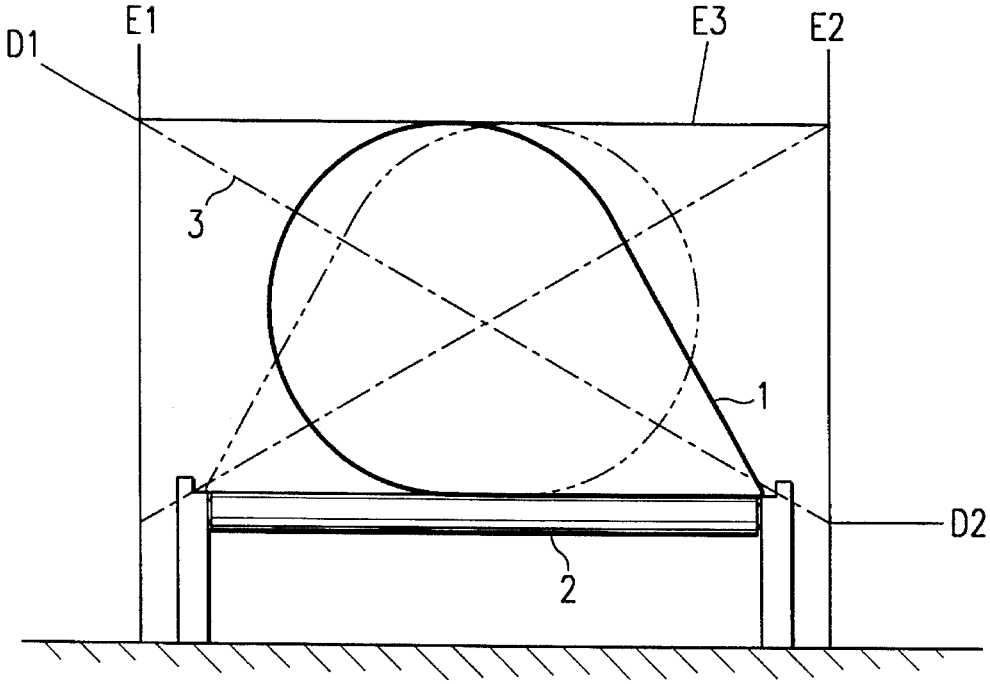

FIGS. 1*a* and 1*b* illustrate an oloid 1 in different positions on a conveyor belt 2, which moves in the direction indicated by the arrows with uniform motion. If the tumbling motion of the oloid 1 takes place in such a manner that the center of gravity remains in a plane $E_3$ perpendicular to the conveyor belt 2, the trace points $D_1$, $D_2$ of the longitudinal oloid axis 3 describe the oval curves $K_1$, $K_2$ on planes $E_1$, $E_2$ which stand upright and run in the same direction as the conveyor belt. The shape and size of these oval curves, $K_1$, and $K_2$, depend on the lateral distances of the planes $E_1$, $E_2$ from the respective edges of the conveyor belt 2.

FIG. 1*a* illustrates the three positions of the oloid 1 during a full revolution. For clarity, FIG. 1*b* illustrates the oloid 1 in only two positions, with the trace points $D_1$ and $D_2$ at the highest and lowest positions in the planes $E_1$ and $E_2$.

Figure 2A:
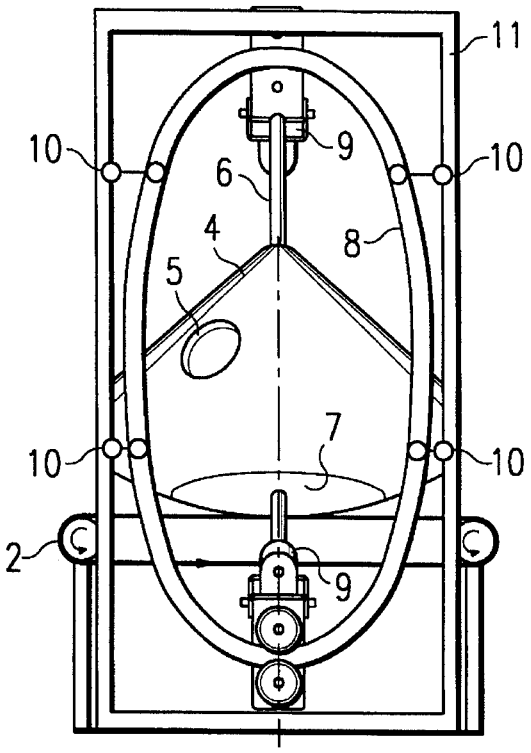
FIG. 2*a* and FIG. 2*b* are side views of one embodiment of the present invention.
Figure 2B:
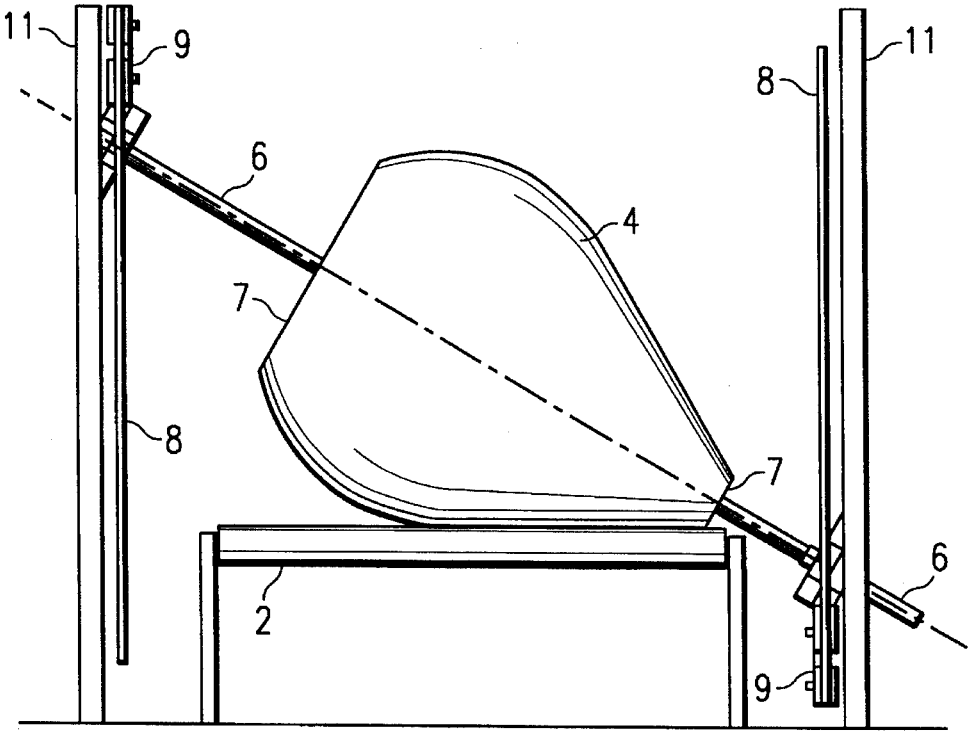

FIGS. 2*a* and 2*b* illustrate a first design version of the present invention. An oloid-shaped, hollow body 4 is positioned on the conveyor belt 2. The oloid-shaped, hollow-body 4 has a shaft 6 attached thereto which has the same position and direction of the longitudinal axis of the oloid shape of the hollow body 4. The shaft 6 is preferably hollow and has a passage in each end which permits access to the oloid-shaped, hollow body 4 during movement of the oloid-shaped, hollow body 4 for the addition and removal of materials and for the introduction of probes. The oloid-shaped, hollow body 4 can be a mixing vessel and have a closeable opening 5. Both ends of this hollow body 4 slightly deviate from the oloid shape in such a way that a segment has been cut off thereby creating the planar areas 7. This slightly reduces the contact line on the conveyor belt 2 in the two extreme positions of the hollow body 4. Thus, the conveyor belt 2 can be designed narrow enough to allow for the shaft 6 to protrude on the sides. The oval curves $K_1$, $K_2$ in FIG. 1*a* are integrated as oval guidance rails 8, of which only one is represented in the illustration, since they are identical if the lateral distances from the conveyor belt 2 are the same and the hollow body 4 moves along the longitudinal direction of the conveyor belt 2. The shaft 6 is driven along the guiding rails 8 by means of a carriage 9. The carriage is illustrated in a side view in FIGS. 2*a* and 2*b* and can be seen in an exploded view in FIGS. 3*a* and 3*b*. The guiding rails 8 differ in shape from the shape of the oval curves $K_1$, $K_2$, since the oval curves $K_1$, $K_2$ are valid for mathematical axes. Therefore, the distance of the rotary axis of shaft 6 from the limits of guiding rail 8 must be taken into consideration. Since small tolerances during the production of the hollow body 4 and its deformation caused by the weight of its payload have to be considered, each of the guiding rails 8 are placed in a solid frame 11 with four spring attachments 10 in such a way that the spring attachments 10 can compensate for the influence of the tolerances. However, the number four is not crucial to this invention. The device can be equipped with six or eight such spring attachments 10. The compensation in the horizontal direction is accomplished by the slip on the conveyor belt 2.

Instead of using a hollow body 4 illustrated in FIGS. 2*a* and 2*b* whose shape deviates from that of the oloid, the purpose of this invention is to adhere to the complete oloid shape and instead reduce the width of the conveyor belt 2 to such an extent as is necessary to compensate for the vertical movement of the shaft 6.

Figure 3A:
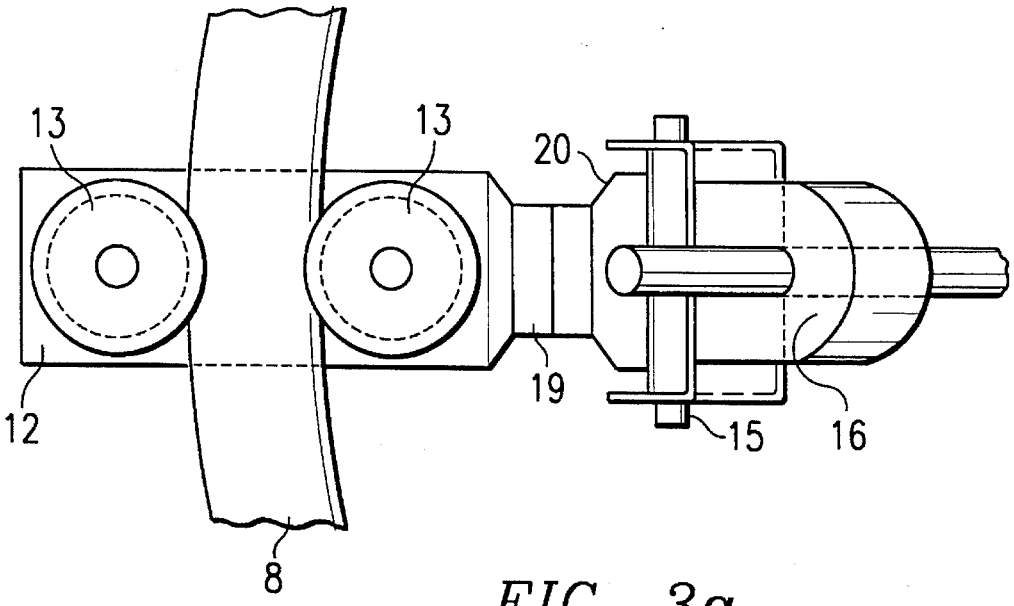
FIG. 3*a* and FIG. 3*b* are enlarged detail views from FIG. 2*a* in a plan view (FIG. 3*a*) and in a partially cutaway view (FIG. 3*b*)
Figure 3B:
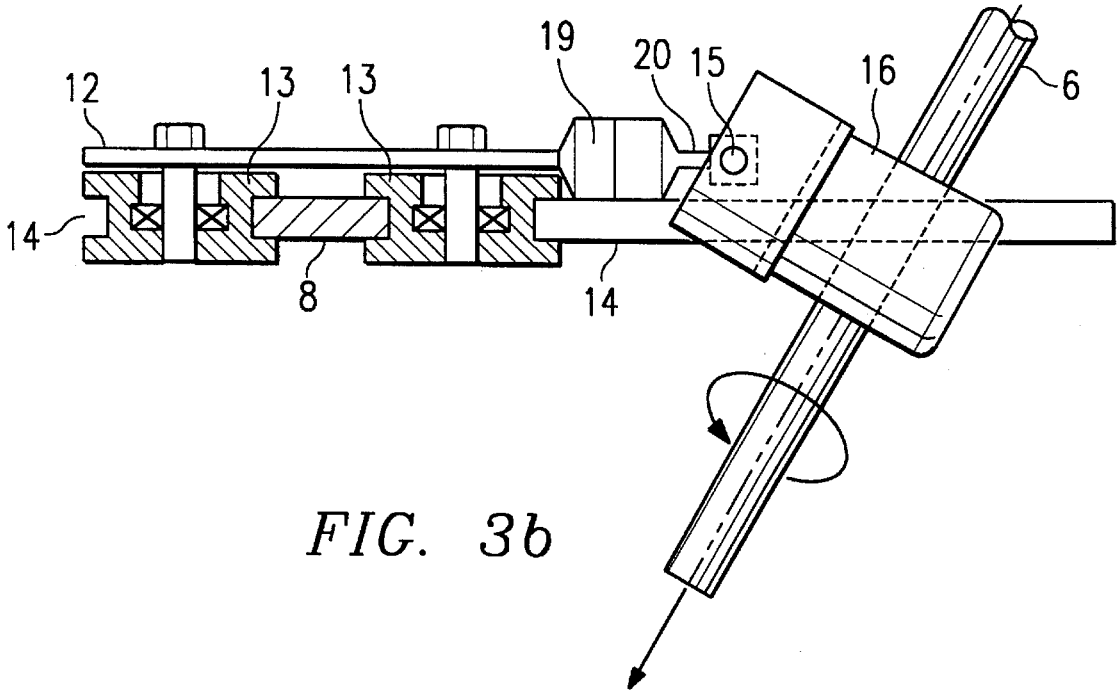

The carriage 9 is illustrated in FIG. 3*a* in a plan view, and in FIG. 3*b* in a partial cutaway view. The carriage 9 consists of a frame 12 that houses two guiding wheels 13 with grooves 14 that could be equipped, for example, with ball bearings. The carriage 9 embraces the guiding rail 8. Therefore, the carriage 9 can only move in the plane defined by the guiding rail 8. The frame 12 houses a pivot 19 against the curving inside of the guiding rail 8, whose rotary axis is perpendicular to the tangent at the guiding rail 8. A pivoting plate 20 is attached to the frame 12 by means of the pivot 19. This plate 20 carries a cross axis 15 that allows for the placement of a traversable guiding element 16. The cross axis 15 is perpendicular to the pivot axis 19 and has the same direction as the tangent at the guiding rail 8.

The shaft 6 is mounted in the guiding element 16 in such a way that it can be turned and moved to the side, as indicated by the arrows in FIG. 3*b*.

Figure 4:
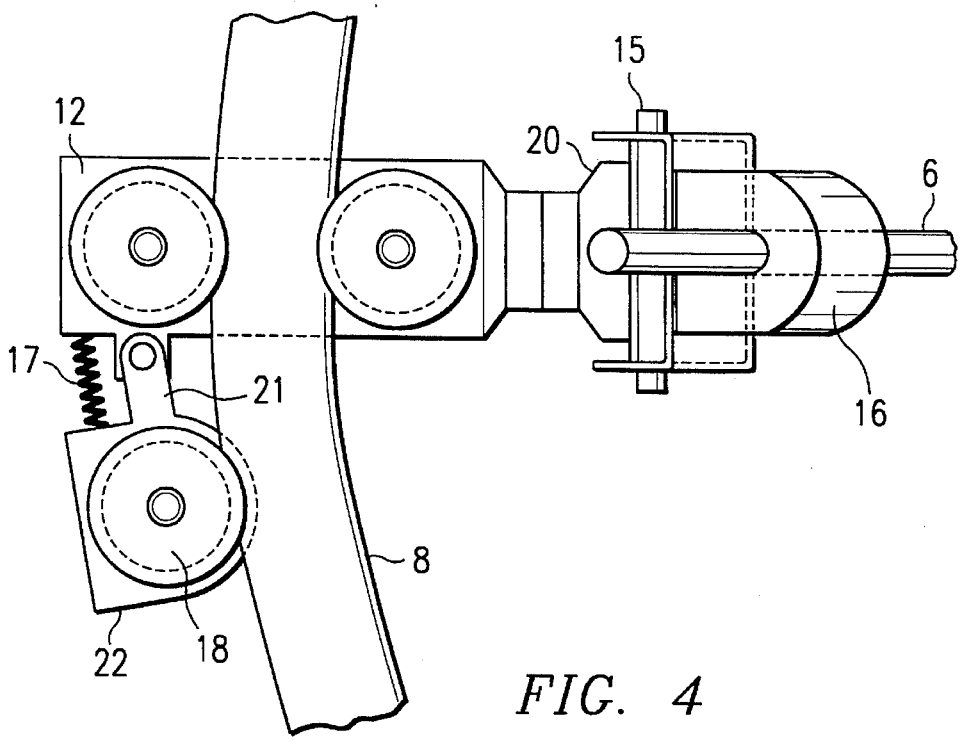
FIG. 4 is a variation of the carriage of FIG. 3*a;*

FIG. 4 illustrates a variation of the carriage 9 shown in FIGS. 3*a* and 3*b*. The carriage 9 in this version has a third guiding wheel 18 that is carried by a frame segment 22 connected to the frame 12 by means of a hinge 21. The frame segment 22 is pushed away from the frame 12 by a spring 17. Thus, the third guiding wheel 18 remains in a friction-type connection with the guiding rail 8.

Figure 5A:
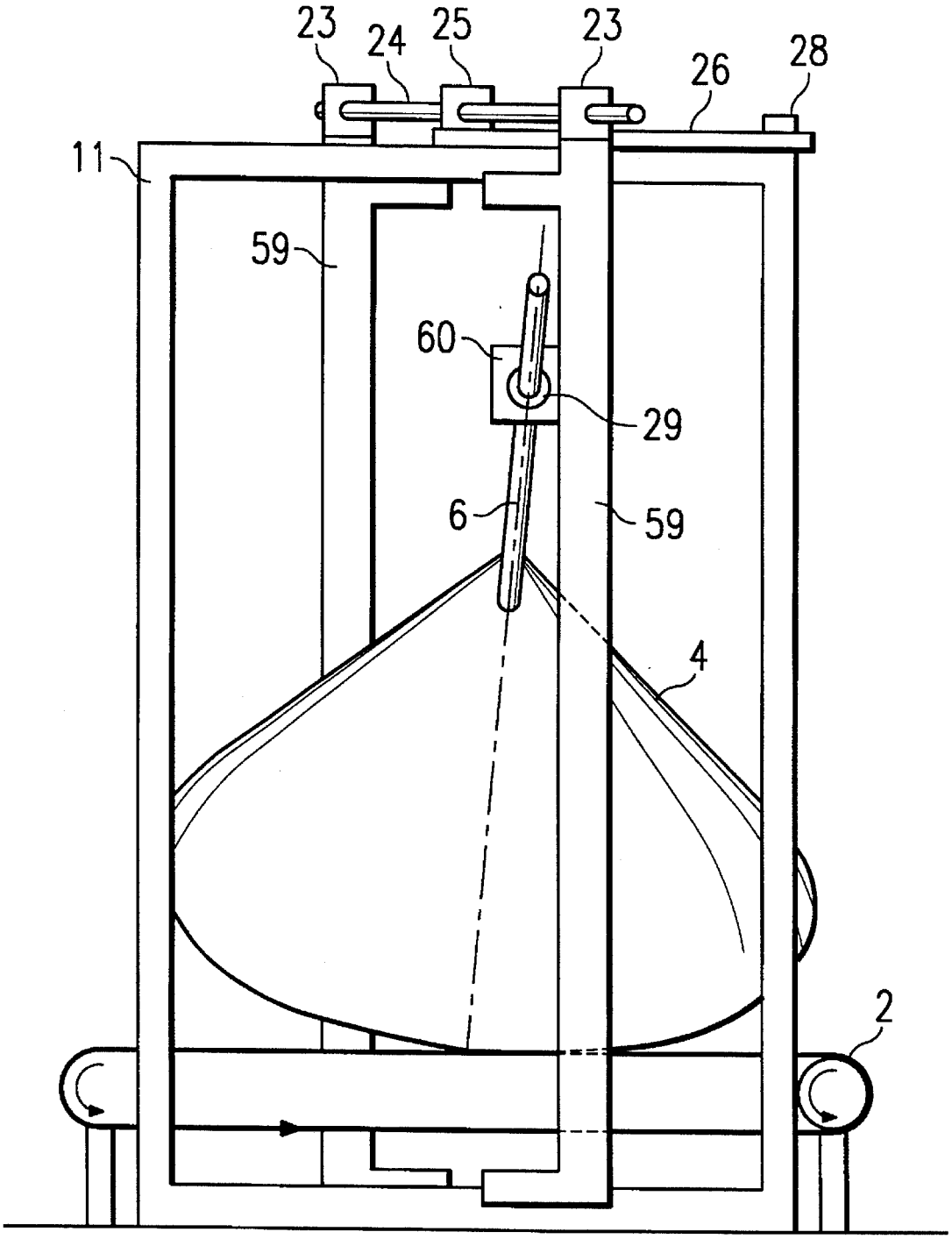
FIG. 5*a* and FIG. 5*b* are alternative design versions in side and plan views, respectively.
Figure 5B:
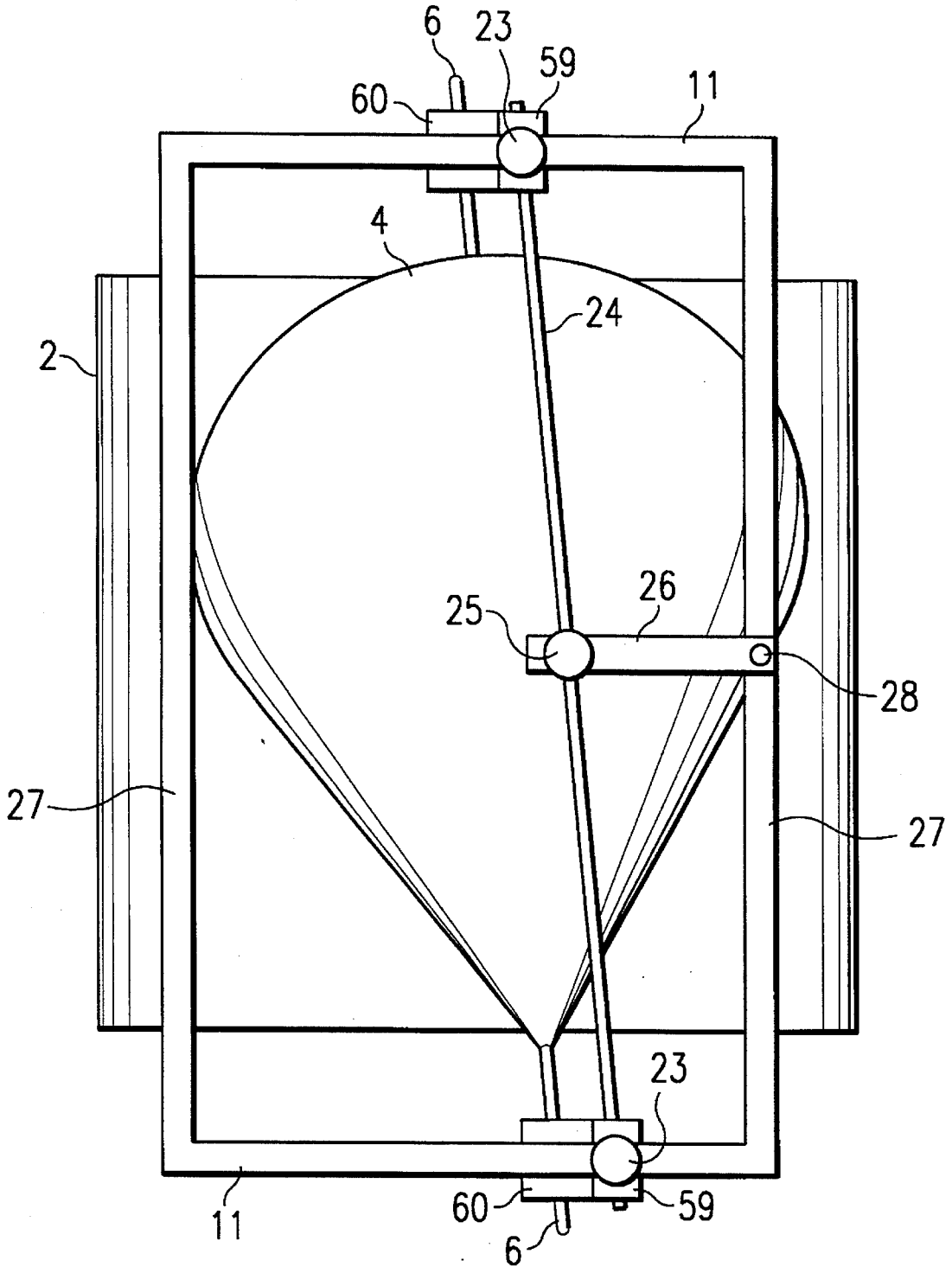

A second design version is illustrated in FIGS. 5*a* and 5*b*. FIG. 5*a* illustrates a cutaway view from the side and FIG. 5*b* shows a plan view.

Each frame 11 carries a slide 59 that can move freely in a horizontal direction. Above the frames 11, both slides 59 carry a bearing element 23 that can be rotated along its vertical axis, which has a plain bearing for a rod 24 that can be axially moved through both bearing elements 23. The mid-section of the rod 24 is attached to a head 25 that can be rotated along its vertical axis. This head is located on a swivel arm 26 that can be rotated along its vertical axis and whose bearing 28 is attached to a crossbeam 27 connecting and stabilizing both frames 11.

The shaft 6 is placed in a ball 29 in such a way that it can be rotated and moved to the side. This ball 29 rotates in a slide 60 that can move freely along the slide 59 in a vertical direction.

When the conveyor belt 2 starts running, the forced guidance caused by the rod 24 keeps the hollow body from running horizontally with the conveyor belt 2 but is forcing it to its inherent tumbling motion. The placement of the rod 24 at the swivel arm 26 compensates for the transverse motion of the hollow body's 4 center of gravity.

Figure 6A:
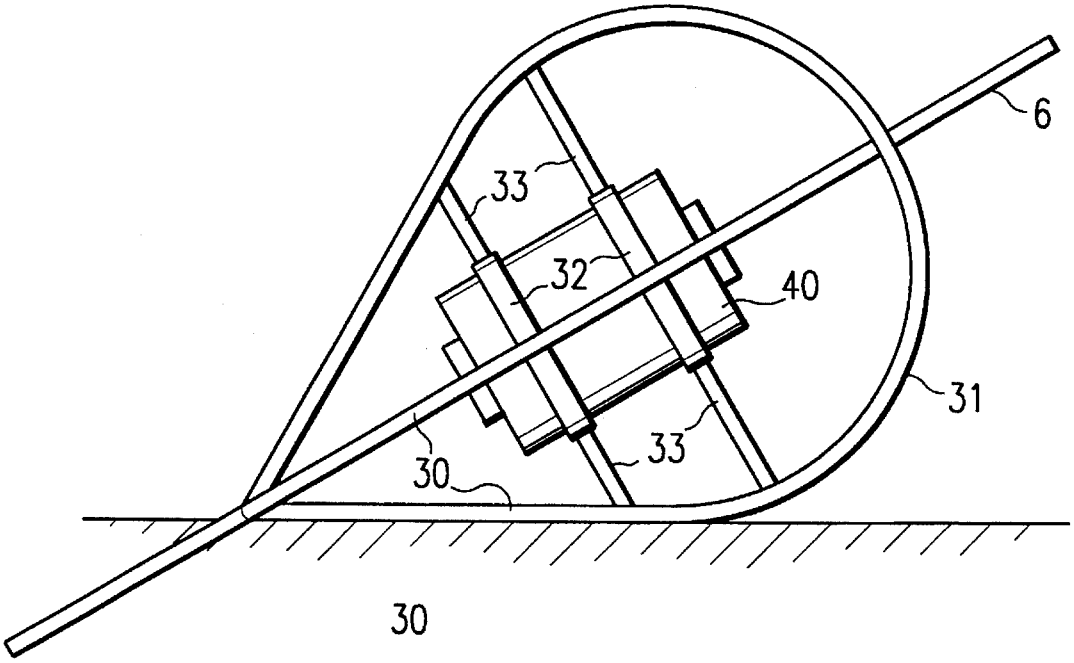
FIG. 6*a* and FIG. 6*b* are plan and cutaway views, respectively, of a variation of a component.
Figure 6B:
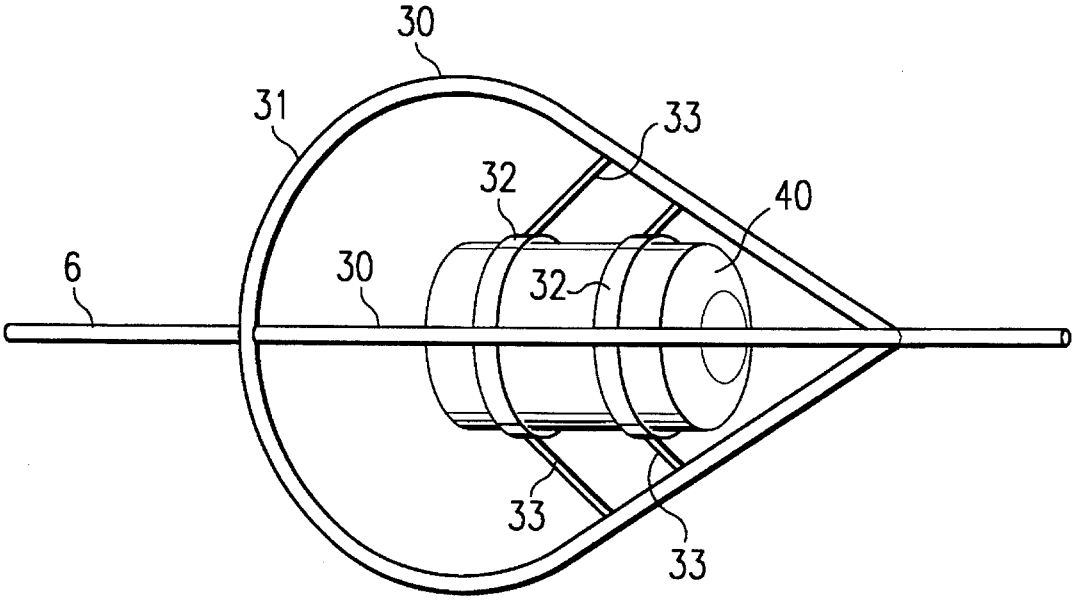

As illustrated in FIGS. 6*a* and 6*b* in plan and cutaway views, respectively, a skeleton body 31 partially made of arcuate rods 30 executes the same motion as the described hollow body 4. This allows for the attachment of a simply-shaped vessel 40, for example, a commercial chemical drum with rods 32 and belts 33 on the inside of the skeleton body 31.

As mentioned above, the shaft 6 can be hollow. This makes the inventive device also suitable for the mixing of liquid and solid materials in a flow process. Therefore, each end of the shaft 6 is equipped with a known rotary passage. Such passages allow for the addition of several components. Moreover, it allows easy access for probes measuring pressure, temperature, pH, and other parameters.

Figure 7:
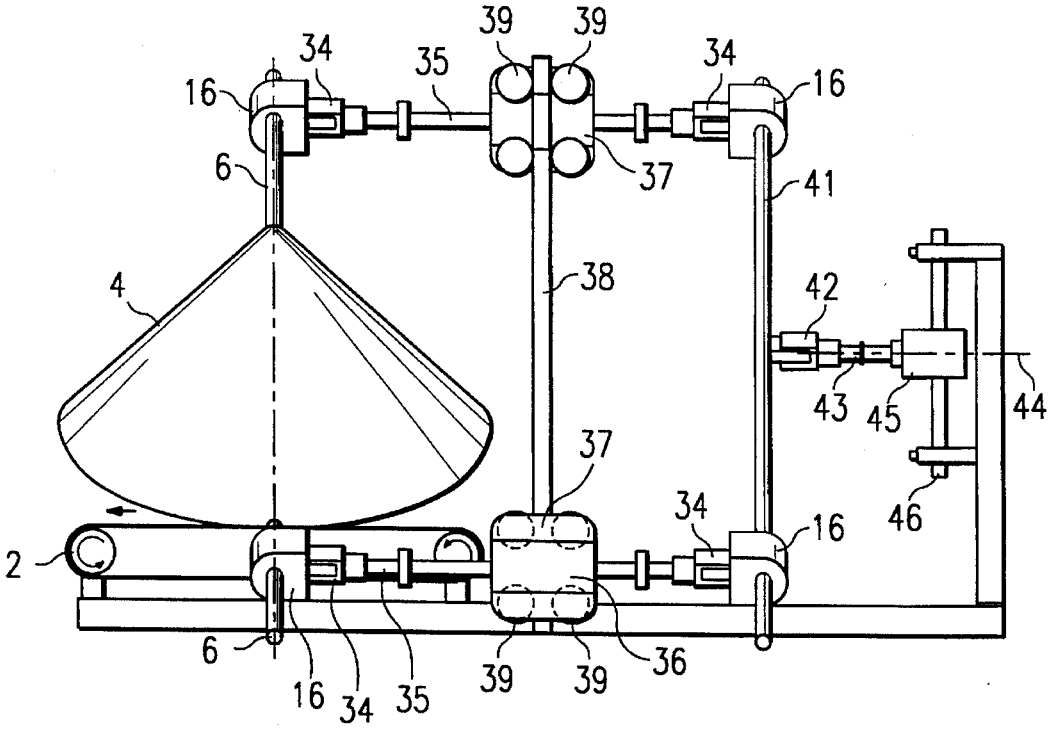
FIG. 7 is yet another alternative embodiment of the present invention.

In the third design version illustrated in FIG. 7, as is the case in the first design version, the oloid hollow body 4 is positioned on the driven belt 2 moving in the direction indicated by the arrows. The shaft 6 runs through the described guiding elements 16, which are connected by joints 34 to one connecting-rod 35 each. These connecting-rods 35 run horizontally in one bearing 36 each, which is carried by a carriage 37 and can execute a vertical motion. The carriages 37 are guided by rollers 39 on two vertical rails 38. The connecting-rod ends 35 facing away from the hollow body 4 are also equipped with joints 34, which with respect to the connecting-rods 35 permit rotating and swivelling motions. These joints 34 are also connected to guiding elements 16. A rod 41 that runs through these guiding elements 16 has a joint 42 attached at its midpoint. The other part of this joint can be rotated in a rotary bearing 43 around an axis 44. The stationary part of the rotary bearing 43 is attached to a guiding element 45 gliding along a vertical rod 46.

When the hollow body 4 moves on the conveyor belt 2 in the tumbling manner, the guiding elements 16 adjacent to the shaft 6 establish the oval curves $K_1$, $K_2$ described in FIG. 1, whose vertical components are supported by the carriage 37 and whose horizontal components are forced by the connecting-rods 35 via the rod 41 onto each other. Thus, they compensate for each other. The vertical movement of the hollow body's 4 geometric center of gravity is made possible by the guiding element 45 gliding along the rod 46.

It is thus believed that the operation and construction of the present invention will be apparent from the foregoing description. While the method and apparatus shown or described has been characterized as being preferred, it will be obvious that various changes and modifications may be made therein without departing from the spirit and scope of the invention as defined in the following claims.

What is claimed is:

1. A device comprising:

a conveyor belt;

a tumbler body having a shape of an oloid and a longitudinal axis, said tumbler body being positioned on said conveyor belt for being driven by said conveyor belt;

a shaft attached to said tumbler body, said shaft having the same position and direction as the longitudinal axis of said tumbler body, said shaft further having a first end and a second end;

means for guiding the first end of said shaft in a first oval path, the first oval path being in a first plane perpendicular to said conveyor belt and having a direction of said conveyor belt; and means for guiding the second end of said shaft in a second oval path, the second oval path being in a second plane perpendicular to said conveyor belt and having a direction of said conveyor belt and being parallel to said first plane.

2. The device as set forth in claim 1, wherein said tumbler body is a closed hollow tumbler body.

3. The device as set forth in claim 2, wherein said closed hollow oloid shaped tumbler body further includes a first planar end and a second planar end, the first and second planar ends each extending radially from said longitudinal axis.

4. The device as set forth in claim 2, wherein said shaft is hollow and has a passage at the first end and the second end, thereby permitting access to said tumbler body during movement of said tumbler body for the addition and removal of materials and for the introduction of probes for testing.

5. The device as set forth in claim 1, wherein said tumbler body comprises a skeleton body having arcuate rods shaped to have a rolling motion characteristic of an oloid.

6. The device as set forth in claim 5, wherein said tumbler body further includes means for attaching a vessel to the inside of the skeleton body.

7. The device as set forth in claim 1, wherein said shaft is hollow and has a passage at the first end and the second end, thereby permitting access to said tumbler body during movement of said tumbler body for the addition and removal of materials and for the introduction of probes.

8. The device as set forth in claim 1, wherein said means for guiding the first end of said shaft and said means for guiding the second end of said shaft each comprise:

a frame;

an oval guidance rail;

a plurality of spring attachments, each of said spring attachments securing said oval guidance rail to said frame;

a carriage, said carriage having at least two wheels rotatably attached to a carriage frame, the at least two wheels being positioned to rotate in the same plane and to hold the oval guidance rail therebetween; and a guide element swivelly and rotatably attached to said carriage, wherein said guide element swivels about an axis in the same plane as the at least two wheels of said carriage and perpendicular to said oval guidance rail and rotates about an axis perpendicular to the axis of swivel, and wherein said shaft is slidably and rotatably connected to said guide element with respect to the longitudinal axis of said tumbler body.

9. The device as set forth in claim 8, wherein said tumbler body is a closed hollow tumbler body.

10. The device as set forth in claim 9, wherein said closed hollow oloid shaped tumbler body further includes a first planar end and a second planar end, the first and second planar ends each extending radially from said longitudinal axis.

11. The device as set forth in claim 9, wherein said shaft is hollow and has a passage at the first end and the second end, thereby permitting access to said tumbler body during movement of said tumbler body for the addition and removal of materials and for the introduction of probes.

12. The device as set forth in claim 8, wherein said tumbler body comprises a skeleton body having arcuate rods shaped to have a rolling motion characteristic of an oloid.

13. The device as set forth in claim 12, wherein said tumbler body further includes means for attaching a vessel to the inside of the skeleton body.

14. The device as set forth in claim 8, wherein said shaft is hollow and has a passage at the first end and the second end, thereby permitting access to said tumbler body during movement of said tumbler body for the addition and removal of materials and for the introduction of probes.

15. A device comprising:

a conveyor belt;

a tumbler body having a shape of an oloid and a longitudinal axis, said tumbler body being positioned on said conveyor belt for being driven by said conveyor belt;

a shaft attached to said tumbler body, said shaft having the same position and direction as the longitudinal axis of said tumbler body, said shaft further having a first end and a second end;

a first frame;

a first vertical slide slidably connected to said first frame, wherein said first vertical slide slides horizontally on said first frame;

a first slide slidably connected to said first vertical slide, wherein said first slide slides vertically on said first vertical slide;

a first ball rotatably attached to said first slide, wherein said first ball rotates globally with respect to the center of said first ball, and wherein the first end of said shaft is slidably and rotatably connected to said first ball with respect to the longitudinal axis of said tumbler body;

a second frame;

a second vertical slide slidably connected to said second frame, wherein said second vertical slide slides horizontally on said second frame;

a second slide slidably connected to said second vertical slide, wherein said second slide slides vertically on said second vertical slide;

a second ball rotatably attached to said second slide, wherein said second ball rotates globally with respect to the center of said second ball, and wherein the second end of said shaft is slidably and rotatably connected to said second ball with respect to the longitudinal axis of said tumbler body;

a cross beam attached at a first end to said first frame and attached at a second end to said second frame;

a horizontal arm attached to said cross beam;

a first bearing element rotatably attached about a vertical axis to said first vertical slide;

a second bearing element rotatably attached about a vertical axis to said second vertical slide;

a third bearing element rotatably attached about a vertical axis to said horizontal arm;

a rod having a longitudinal axis, said rod being slidably and rotatably connected about the longitudinal axis of said rod to said first bearing element, said second bearing element, and said third bearing element.

16. The device as set forth in claim 15, wherein said horizontal arm is rotatably attached about a vertical axis to said cross beam.

17. The device as set forth in claim 15, wherein said rod is attached in a fixed manner to one of said first bearing element, said second bearing element, and said third bearing element.

18. The device as set forth in claim 17, wherein said rod is attached in a fixed manner to said third bearing element.

19. The device as set forth in claim 15, wherein said tumbler body is a closed hollow tumbler body.

20. The device as set forth in claim 19, wherein said closed hollow oloid shaped tumbler body further includes a first planar end and a second planar end, the first and second planar ends each extending radially from said longitudinal axis.

21. The device as set forth in claim 19, wherein said shaft is hollow and has a passage at the first end and the second end, thereby permitting access to said tumbler body during movement of said tumbler body for the addition and removal of materials and for the introduction of probes.

22. The device as set forth in claim 15, wherein said tumbler body comprises a skeleton body having arcuate rods shaped to have a rolling motion characteristic of an oloid.

23. The device as set forth in claim 22, wherein said tumbler body further includes means for attaching a vessel to the inside of the skeleton body.

24. The device as set forth in claim 15, wherein said shaft is hollow and has a passage at the first end and the second end, thereby permitting access to said tumbler body during movement of said tumbler body for the addition and removal of materials and for the introduction of probes.

25. A device comprising:

a conveyor belt;

a tumbler body having a shape of an oloid and a longitudinal axis, said tumbler body being positioned on said conveyor belt for being driven by said conveyor belt;

a shaft attached to said tumbler body, said shaft having the same position and direction as the longitudinal axis of said tumbler body, said shaft further having a first end and a second end;

a first vertical rail;

a first carriage slidably connected to the first vertical rail, wherein said first carriage slides vertically on said first vertical rail;

a first connecting rod slidably connected to said first carriage, wherein said first connecting .rod slides horizontally on said first carriage;

a second vertical rail;

a second carriage slidably connected to the second vertical rail, wherein said second carriage slides vertically on said second vertical rail;

a second connecting rod slidably connected to said second carriage, wherein said second connecting rod slides horizontally on said second carriage;

a first guide element swivelly and rotatably attached to said second connecting rod, wherein said first guide element swivels with respect to the longitudinal axis of said first connecting rod and rotates about an axis perpendicular to the axis of swivel, and wherein the first end of said shaft is slidably and rotatably connected to said first guide element with respect to the longitudinal axis of said tumbler body;

a second guide element swivelly and rotatably attached to said second connecting rod, wherein said second guide element swivels with respect to the longitudinal axis of said second connecting rod and rotates about an axis perpendicular to the axis of swivel, and wherein the second end of said shaft is slidably and rotatably connected to said second guide element with respect to the longitudinal axis of said tumbler body;

a third guide element swivelly and rotatably attached to said second connecting rod, wherein said third guide element swivels with respect to the longitudinal axis of said first connecting rod and rotates about an axis perpendicular to the axis of swivel;

a fourth guide element swivelly and rotatably attached to said second connecting rod, wherein said fourth guide element swivels with respect to the longitudinal axis of said second connecting rod and rotates about an axis perpendicular to the axis of swivel;

a cross rod slidably and rotatably connected to said third guide element and said fourth guide element with respect to the longitudinal axis of said cross rod;

a fifth guide element swivelly and rotatably attached to said cross rod, wherein said fifth guide element swivels about an axis perpendicular to the longitudinal axis of said cross rod and rotates about an axis perpendicular to the axis of swivel; and a stationary vertical rod, said fifth guide element being slidably and rotatably connected to said stationary vertical rod, wherein said fifth guide element rotates and slides on said stationary vertical rod with respect to an axis which is perpendicular to the axis of swivel for said fifth guide element.

26. The device as set forth in claim 25, wherein said tumbler body is a closed hollow tumbler body.

27. The device as set forth in claim 26, wherein said closed hollow oloid shaped tumbler body further includes a first planar end and a second planar end, the first and second planar ends each extending radially from said longitudinal axis.

28. The device as set forth in claim 26, wherein said shaft is hollow and has a passage at the first end and the second end, thereby permitting access to said tumbler body during movement of said tumbler body for the addition and removal of materials and for the introduction of probes for testing.

29. The device as set forth in claim 25, wherein said tumbler body comprises a skeleton body having arcuate rods shaped to have a rolling motion characteristic of an oloid.

30. The device as set forth in claim 29, wherein said tumbler body further includes means for attaching a vessel to the inside of the skeleton body.

31. The device as set forth in claim 25, wherein said shaft is hollow and has a passage at the first end and the second end, thereby permitting access to said tumbler body during movement of said tumbler body for the addition and removal of materials and for the introduction of probes.

* * * * *